United States Patent [19]

Borel

[11] 4,445,710

[45] May 1, 1984

[54] MULTISHEET BINDER AND ASSEMBLY

[75] Inventor: Pierre Borel, Saint Martin d'Heres, France

[73] Assignee: Jowa, Grenoble, France

[21] Appl. No.: 425,864

[22] Filed: Sep. 28, 1982

[51] Int. Cl.[3] ..... B42D 17/00; B42F 11/00

[52] U.S. Cl. ..... 281/45; 402/75; 402/502

[58] Field of Search ..... 281/45, 46, 47, 48, 281/49; 402/37, 501, 502, 75, 74, 73

[56] References Cited

U.S. PATENT DOCUMENTS 2,127,619 8/1938 Rosenthal ..... 281/17

3,909,141 9/1975 Staats ..... 281/17 X

FOREIGN PATENT DOCUMENTS 2318394 11/1973 Fed. Rep. of Germany ..... 281/17

*Primary Examiner*—Paul A. Bell

*Assistant Examiner*—John S. Brown

*Attorney, Agent, or Firm*—Karl F. Ross; Herbert Dubno

[57] ABSTRACT

A binding for documents, sheets, pouches and other members in which each member is formed with a synthetic resin profile having a web attached to the member and a bead lying along an edge of the respective assembly. The support is formed with a plurality of slots having windows at least at one end thereof through which the beads can be inserted and removed longitudinally and such that the beads are thicker than the widths of the slots but thinner than the widths of the windows.

6 Claims, 4 Drawing Figures

MULTISHEET BINDER AND ASSEMBLY

FIELD OF THE INVENTION

My present invention relates to a sheet-retaining structure or assembly and, more particularly to a binder or like assembly capable of retaining a multiplicity of sheets or, more generally, flat members having a retained edge so as to enable these members to be removed and, when in place, to be relatively mobile.

BACKGROUND OF THE INVENTION

The need to support a generally flat member along an edge thereof is widespread and applies to members of various forms, including sheets in which a multiplicity of such members may be retained on a common support. For example, this is the case with a binder adapted to secure corresponding edges of a multiplicity of sheets in such manner as to enable the sheets to be inspected or accessed. The use of the term "binder" is thus utilized here in its broadest possible sense to include a binder in the form of the spine of a book or simply a member at which a plurality of sheets can be assembled.

Similarly, the term "sheet" is utilized in its broadest sense to refer to flexible or rigid members havng a rectilinear edge and which may have, apart from this edge, any desired shape, thickness or rigidity or composition.

Thus, the invention can relate to binders for sheets of paper or cardboard, to a binder for photographs or photograph-carrying supports, to a support structure for flat members such as floor or wall covering materials, to flat pouches receiving articles or substances (e.g. samples) and for rigid or flexible objects if diverse sorts, all of which are held together along their corresponding edges in a common support which may be in the form of a book spine or assembly, a support member adapted to be mounted upon a surface, an enclosed structure or a simple free-standing structure.

It is convenient to describe the invention, however, in terms of the binding of documents, i.e. a system utilizing sheets which are composed of paper and a support which forms a book spine, but throughout this disclosure, it should be understood that, unless otherwise limited, by the claims, the terms are to be interpreted in their broadest sense because of the vast scope of the application of the invention.

Binding systems used in offices, especially where removal of the sheet is desired, have hitherto utilized complex supports with rings, posts or other separable members adapted to pass through holes previously provided in the sheets. Alternatively, the support was provided with a spring or other clamping structure adapted to compress the edges of the sheets between two surfaces and yet another arrangement, a resilient channel-shaped member, was forced over the edges of a number of sheets to engage them with or without the intervention of a cover member.

All of these systems had various drawbacks and some of these can be enumerated. For example, where the support had rings, a post or like structure which engaged through holes in the sheets, the holes tended to tear with opening and closing of the stack and with heavy use of the bound article. The support itself was comparatively expensive and removal of an individual sheet frequently required opening of the entire structure so that sheets, which were intended to remain in place, were inadvertently released.

The clamping systems also utilized complex mechanisms or were incapable of retaining the sheets, especially when the latter were heavy or stiff.

Furthermore, the versatility of conventional systems left much to be desired because systems which were satisfactory for thin sheets could not be utilized for heavy or stiff sheets and, in general, the sheet-retaining arrangements could not be utilized for holding other members such as floor or wall coverings, pouches containing articles to be displayed or vended, or the like.

Where satisfactory retention force could be provided, it usually was at the expense of being able to remove or replace the member or resulted in excessive cost for the binding system.

OBJECTS OF THE INVENTION

It is, therefore, the principal object of the present invention to provide an improved binding assembly which avoids the drawbacks and difficulties hitherto encountered and which enables even comparatively stiff and heavy members to be removably retained on a support.

Yet another object of this invention is to provide a low cost and strong binding arrangement which nevertheless allows individual sheets or members to be removed and replaced without operational problems characterizing earlier devices.

SUMMARY OF THE INVENTION

These objects and others which will become apparent hereinafter are attained, in accordance with the present invention, in a system for securing a plurality of flat members along corresponding edges thereof to a support having a face with respect to which these members lie generally transverse, wherein the binding is formed with at least one groove extending over the length of the edge for each of these members and the respective edge of the member is formed with at least one bead preferably extending over this edge continuously but, in any event, formed over at least part of this edge, the groove having a width which is less than the width of the bead.

According to the invention, the groove is closed at both its ends but at least one end thereof is provided with a window having a width greater than the width of this bead.

The width of the bead, of course, corresponds to the thickness thereof measured perpendicular to the plane of the flat member and thus the invention can be described as a binding in which a spine or backing member is formed with at least one groove cooperating with a rib, bar, elongated protuberance or other edge-like formation, hereinafter referred to as a bead, fixed to the document or sheet to be secured to the spine.

According to the invention, each groove is closed at both of its ends and is provided with at least one window permitting the bead, which is rigid with the document to be bound, to be introduced into the groove or extracted from the latter longitudinally through this window, the bead having a thickness less than the width of the window but greater than the width of the groove.

The spine serving as a support for the document or documents can be independent of other binding elements or can be fixed to or incorporated in some other element, e.g. a binding or cover structure. The spine can have a plurality of such grooves arranged in parallel to one another to receive respective documents and each bead can be formed on a separate member connected to one or more documents or sheets, e.g. by stapling, adhesives or other means.

In the most common case, the spine will present a planar face which is formed with a multiplicity of mutually parallel rectilinear grooves each associated with at least one window with the respective window being located preferably at an end of the groove, either the upper end or the lower end when the spine is held erect to enable the bead to be inserted into or moved from the window at the respective end.

Of course, when such a window is provided at each of the opposite axial ends of each groove, a sheet can selectively be removed and inserted through either end, i.e. from the top or the bottom of the binding. The term "window" is used herein to refer to the enlargement in the width of the slot at each end, this enlargement extending in length only over a fraction of the length of the slot.

Since the sheet or the bead-carrying member must slide along the groove between the confronting edges thereof from the insertion window, it has been found to be advantageous to relieve friction by providing this confronting edge with spaced-apart indentations along their length. The indentations can advantageously be intermediate windows spaced inwardly from the terminal windows and from each other.

The spine serving as the element for holding the sheets togehter can be constituted of any desired material and will generally be fabricated by a method appropriate to the material chosen. Preferably, it is composed of a thermoplastic synthetic resin material and produced by injection molding. The indentations and multiple window structure previously described has been found to be advantageous in this case because it simplifies the molding process and reduces the complexity of the mold.

The member is firmly retained because the bead preferably extends continuously over its entire length along the edge of the member and thus bears over its entire length, except for interruptions in the region of the indentations, upon the reverse side of the spine. The bead can, it has been noted, be formed independently from the sheet or flat member to be mounted in the binding and preferably is an extruded thermoplastic synthetic resin, having a web to which the document or member is affixed by heat sealing, stapling or the like while the bead is shaped during the injection molding process integrally with this web.

In a particularly advantageous embodiment of the invention, the sheet or member is a synthetic resin foil pouch which can be provided integrally with the bead or to which the bead-carrying member is bonded by heat sealing, the pouch being preferably transparent to contain articles to be presented for sale or other consideration in the binder.

Of course, other means such as adhesive binding, may be used to secure the web of the bead-carrying member to the sheet.

BRIEF DESCRIPTION OF THE DRAWING

The above and other objects, features and advantages of the prsent invention will become more readily apparent from the following description, reference being made to the accompanying drawing in which.

SPECIFIC DESCRIPTION

Figure 1:
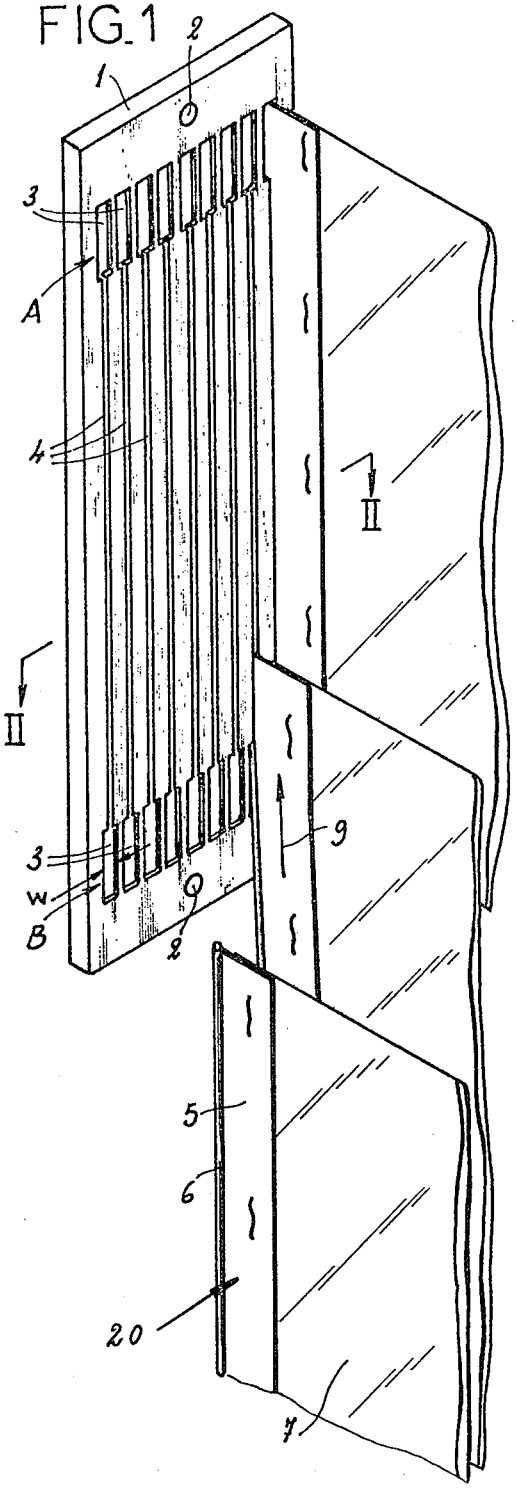
FIG. 1 is a perspective view showing a binding in accordance with the invention having one sheet in place and two other sheets in various positions for assembly to the binding.
Figure 4:
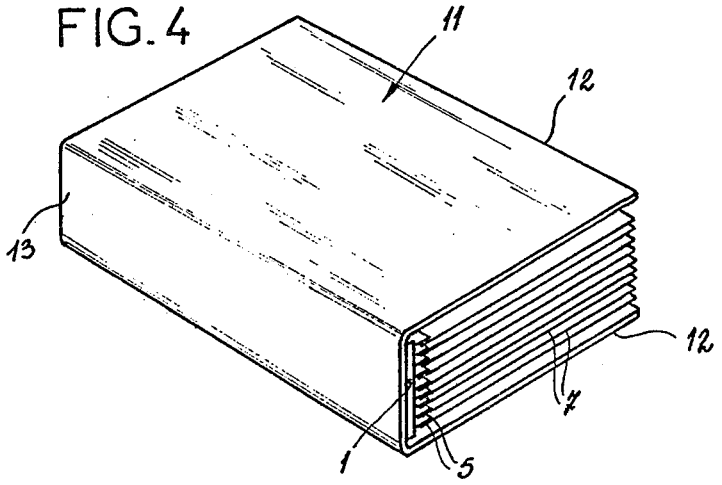
FIG. 4 is a perspective view showing the binding assembly of FIGS. 1 and 2, for example, incorporated between covers or in book structure.

As can be seen from FIGS. 1 and 4, a rectilinear support 1 can form a spine which is injection molded from a synthetic resin and can be fixed to some other support or member, e.g. by holes 2 disposed at the top and bottom of this spine 1. Specifically, these holes can be traversed by pins, rivets, screw or any other fastening means and can be utilized to secure the member 1 between the covers 12 of a book structure having a back 13 to which the spine is affixed. Obviously, other means of attaching the spine to any other support may also be utilized.

Figure 2:
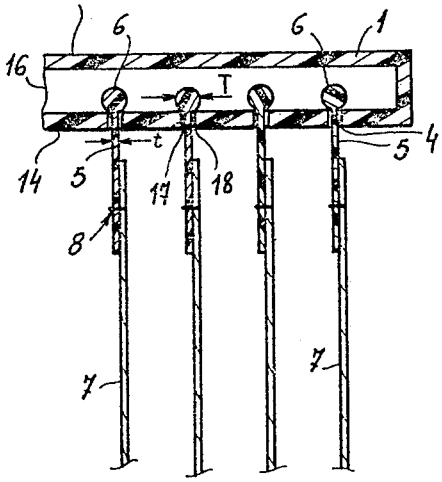
FIG. 2 is a cross sectional view taken along the line II—II of FIG. 1.

As can be seen from FIG. 2, moreover, the spine 1 is hollow and has front and back walls 14 and 15, respectively, the grooves 4 being provided only in the front wall so that the back wall can lie flush against a support surface.

Since the walls 14 and 15 are spaced apart, they define a compartment 16 adapted to receive the spines.

According to the invention, for each of the sheets or other flat members 7 to be removably received on the spine 1, there is a rectilinear groove 4 which is formed in the spine and, more particularly, in the front face 14 thereof, this groove being constituted as a slot whose edges 17 and 18 are spaced apart by a distance w.

The slots 4 are mutually parallel and terminate at their opposite ends in respective windows 3 having widths W. These windows are disposed in two rows A and B, disposed respectively proximal to the top of the support and proximal to the bottom thereof. The windows 3 can also be considered to be paired, each two windows 3 being connected by a rectilinear slot 5.

In the embodiment shown in FIGS. 1 ans 2, nine windows 3 are provided in each row and hence there are nine pairs of windows and nine slots so that nine sheets 7 can be received in the spine and, of course, a lesser number can be carried by the latter although, if a greater number is desired, additional slots must be provided thereon.

Each of the members 7 is provided with a profile 20 formed by extrusion and composed of thermoplastic synthetic resin material, the profile consisting of a flat web 5 and a bead 6 integral with one another.

The web 5 serves for attachment to the member to be bound, in this case pouches 7 of synthetic resin foil material, preferably a transparent material which can receive a document or other element for presentation or storage.

Each of the pouches 7 is fixed to the web 5, for example by staples 8, as shown, by an adhesive or by thermowelding.

The bead 6 has a thickness T as measured transversely to the plane of the member to which it is secured and, when this bead is generally cylindrical as shown, this thickness T is equal to its diameter.

According to the invention the thickness t of the web is less than the width w of the respective slot while the thickness T of the bead is less that the width W of the respective window but substantially greater than the width w of the slot.

As can be seen from FIG. 1, therefore, an end of the bead can be inserted through the lower window of a respective slot and shifted upwardly as represented by the arrow 9 until the lower end of the bead passes into this window whereupon the bead is anchored behind the edges 17 and 18 of the slot (see FIG. 2) and the member 7 is retained. Any deflection of these edges or of the bead to permit this insertion and reverse withdrawal of a bead from the slot is permitted by the flexibility of the synthetic resin wall 14 and extruded member 20. The bead is thus engaged by the edges of the slot practically over its entire length. Mounting of a document carrier 7, with or without its document, is simple and its removal is equally simple since it is merely necessary to withdraw one end of the bead through an upper or lower window and then slide the bead out of the slot.

Figure 3:
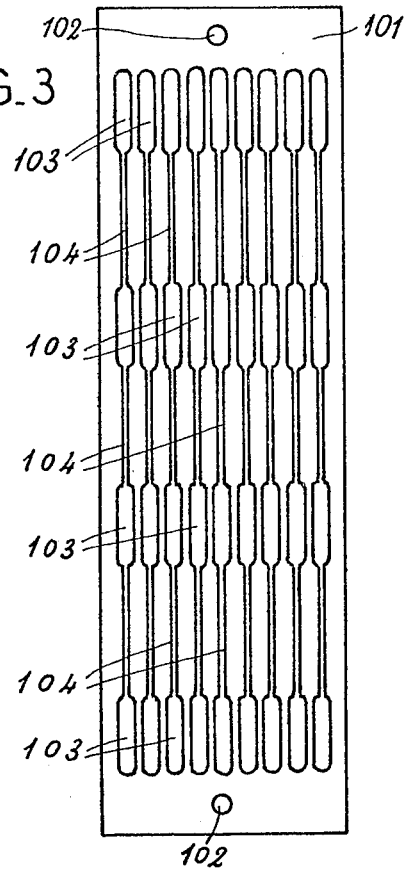
FIG. 3 is a top plan view of a spine according to another embodiment of the invention.

The spine 101 shown in FIG. 3 differs from that of FIGS. 1 and 2 in that a number of windows 103' are provided between the terminal windows 103 so that the slots 104 are effectively subdivided into a number of sections. In the embodiment shown, four sets of windows are provided. This has been found to facilitate the fabrication of the spine by injection molding from thermoplastic material and to allow a number of members having edge lengths less than the full height of the spine to be mounted in coplanar relationship in a given slot utilizing insertion through the intermediate windows. In addition, this arrangement reduces the friction when a full length edge bead is inserted.

While the preferred mode of mounting the spine 1 or 101 in a cover 11 is by the use of rivets through holes 2, 102, it is also possible to attach the spine by other means, e.g. heat sealing, electronic welding, electronic fusion of heads or pins integral with the spine, etc.

The invention, of course, is not limited to the embodiment shown but incorporates all modifications thereof within the scope of the claims, especially those which relate to the materials and methods of fabricating the assembly.

I claim:

1. A binding for retaining a plurality of flat members comprising:

an elongated support formed with a plurality of longitudinally extending throughgoing slots in a spaced-apart parallel relationship and each closed at both opposite ends, each of said slots having an enlargement at one end thereof with a width greater than the width of an adjacent portion of the respective slot and a length less than that of the slot, each of said enlargements constituting a window in said support; and a longitudinally extending bead formed on an edge of each of said members and insertable through a respective window whereby said bead underlies the respective slot, said bead having a thickness less than the width of said window but greater than the width of said slot.

2. The binding defined in claim 1 wherein at least some of said slots have respective such enlargements formed at the tops thereof.

3. The binding defined in claim 1 wherein at least some of said slots have respective such enlargements formed at the bottoms thereof.

4. The binding defined in claim 1 wherein each of said slots has respective such enlargements formed both at the top and bottom thereof.

5. The binding defined in claim 1, further comprising additional enlargements of limited length defining windows spaced apart along each of said slots.

6. The binding defined in claim 1, claim 2, claim 3, claim 4 or claim 5 wherein each of said beads is formed from synthetic resin material from an extruded element having a web connected to the respective member and passing through the respective slot, each web having a thickness less than the width of the respective slot, each bead being formed unitarily with the respective web and having a cylindrical configuration with its diameter forming the thickness of the bead, said support comprising a box-like structure having a wall provided with said slots and said window whereby said beads are removably received within said structure.

* * * * *